US006552659B1

(12) United States Patent
Waltz et al.

(10) Patent No.: US 6,552,659 B1
(45) Date of Patent: Apr. 22, 2003

(54) DEVICE FOR TRANSMITTING MECHANICAL CONTROL MOVEMENTS AND/OR ELECTRIC SIGNALS BETWEEN A DOOR ACTUATING DEVICE AND A DOOR CLOSER DEVICE OF A MOTOR VEHICLE DOOR

(75) Inventors: Uwe Waltz, Bamberg (DE); Eberhard Pleiss, Untersiemau (DE); Manfred Stenzel, Bamberg (DE)

(73) Assignee: Brose Fahrzeugteile GmbH & Co. KG, Coburg, Coburg (DE)

( * ) Notice: Subject to any disclaimer, the term of this patent is extended or adjusted under 35 U.S.C. 154(b) by 0 days.

(21) Appl. No.: 09/462,035

(22) PCT Filed: Jun. 30, 1998

(86) PCT No.: PCT/DE98/01861

§ 371 (c)(1),
(2), (4) Date: Dec. 29, 1999

(87) PCT Pub. No.: WO99/01635

PCT Pub. Date: Jan. 14, 1999

(51) Int. Cl.[7] ..... G08B 13/08
(52) U.S. Cl. ..... 340/545.1; 340/438; 340/5.72
(58) Field of Search ..... 340/5.2, 5.55, 340/5.62, 5.65, 5.66, 5.67, 5.72, 426, 438, 542, 545.1, 548; 292/201, 216, 240; 70/277, 278.3, 279.1, 208

(56) References Cited

U.S. PATENT DOCUMENTS

| | | | | |
|---|---|---|---|---|
| 5,140,316 A | * | 8/1992 | DeLand et al. | 340/825.69 |
| 5,153,410 A | * | 10/1992 | Barnes | 219/201 |
| 5,367,295 A | | 11/1994 | Gokcebay et al. | 340/825.31 |
| 5,684,470 A | * | 11/1997 | DeLand et al. | 340/825.69 |
| 5,791,178 A | | 8/1998 | Chamberlain et al. | 70/278 |
| 5,898,365 A | * | 4/1999 | Niederlein | 340/425.5 |
| 6,050,117 A | * | 4/2000 | Weyerstall | 70/277 |

FOREIGN PATENT DOCUMENTS

| | | |
|---|---|---|
| DE | 32 36 201 | 4/1984 |
| DE | 36 10 536 | 10/1987 |
| DE | 40 26 217 | 2/1992 |
| DE | 296 09 204 | 11/1997 |
| EP | 0 692 595 | 1/1996 |
| FR | 2 738 586 | 3/1997 |
| JP | 07269203 | 10/1995 |

* cited by examiner

*Primary Examiner*—Van Trieu
(74) *Attorney, Agent, or Firm*—Christie, Parker & Hale, LLP

(57) ABSTRACT

Device for transferring mechanical setting movements and/or electrical signals between a door operating device (3) and a door closing device (4) of a motor vehicle door for the mechanical door functions opening/closing and locking/unlocking as well as for electrical lock functions. A one-piece coupling element (5) which is capable of translation and/or rotational displacement and which mechanically and/or electrically transfers both door functions between the door operating device (3) and the door closing device (4) is provided with at least one plug which can be connected to an electrical contacting site mounted on the door closing device (4) or on the support plate, wherein the control signals for both door functions can be transferred through the electrical contacting site or the control signals for one door function can be transferred through the electrical contacting site whilst the other door function can be transferred rotationally or in translation through the coupling element (5).

34 Claims, 9 Drawing Sheets

FIG. 9
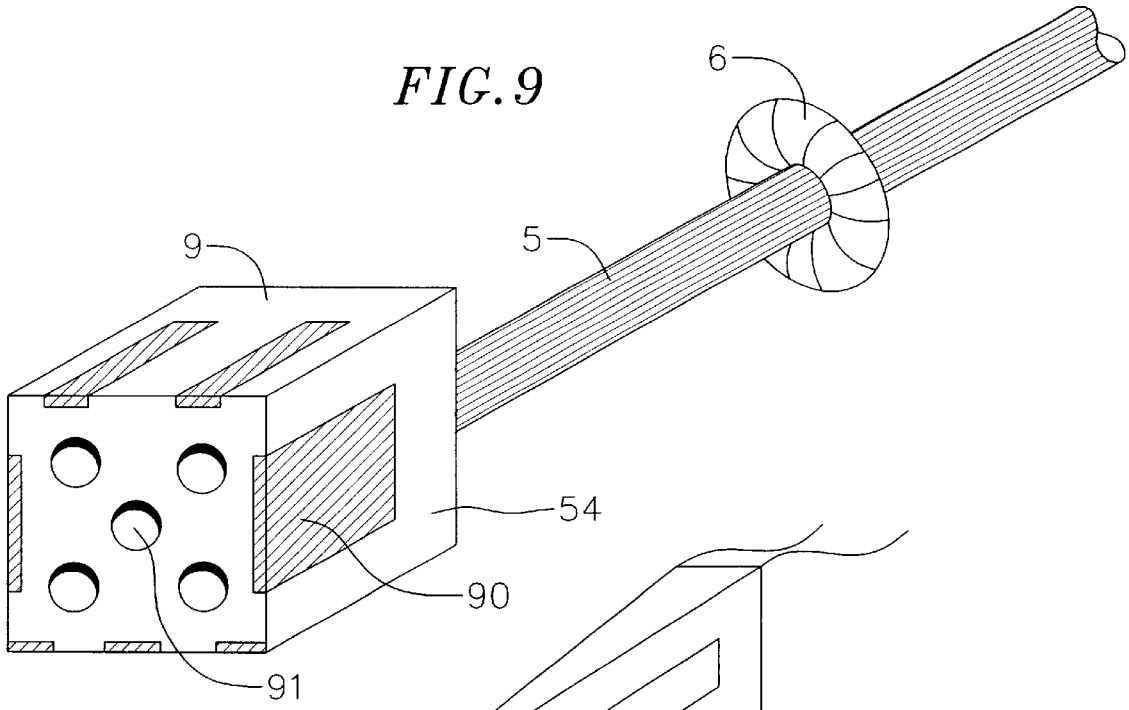
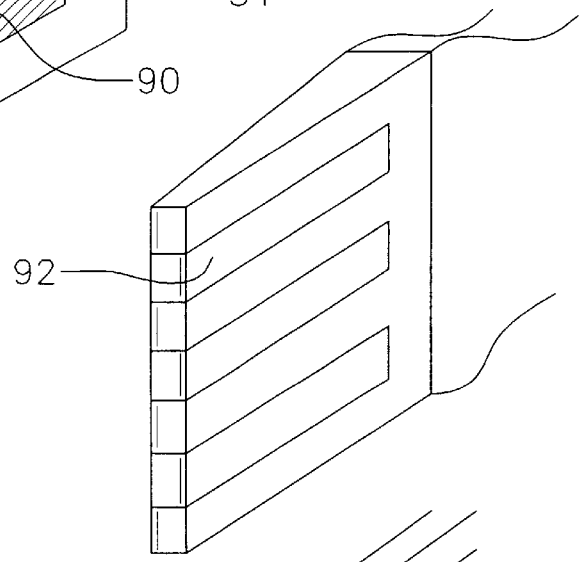
FIG. 10
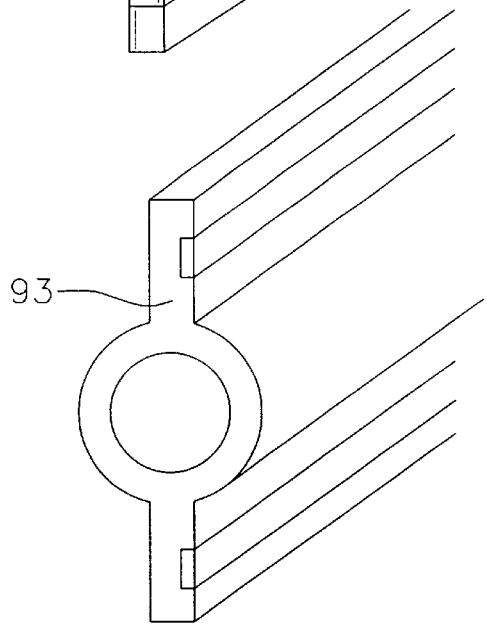
FIG. 11

DEVICE FOR TRANSMITTING MECHANICAL CONTROL MOVEMENTS AND/OR ELECTRIC SIGNALS BETWEEN A DOOR ACTUATING DEVICE AND A DOOR CLOSER DEVICE OF A MOTOR VEHICLE DOOR

BACKGROUND OF THE INVENTION

The invention relates to a device for transferring mechanical setting movements and/or electrical signals between a door operating device and a door closing device of a motor vehicle door.

From EP 0 692 595 A1 a device is known for transferring mechanical setting movements between a door operating device and a door closing device of a motor vehicle door, which consists of a Bowden cable which transfers the mechanical door functions of opening and closing as well as locking and unlocking from the door operating device to the door closing device. Operating the exterior door handle of the door operating device leads to a longitudinal movement of the inner cable of the Bowden cable and to an opening of the door closing device, whilst a turning of the door lock is converted into a rotary movement of the inner cable which engenders locking and unlocking of the door closing device.

A transfer device between a door operating device and a door closing device of a motor vehicle door, known from JP 07 269 203 A consists of an inner cable which transfers traction forces in an axial direction and of an outer tube enclosing the inner cable and mounted to rotate about the inner cable. Operating the exterior door handle of the door operating device leads to an axial movement of the inner cable whilst a rotary movement of the locking and unlocking mechanism of the door operating device leads to a rotary movement of the outer tube in both rotary directions and thus engenders a locking and unlocking of the door closing device.

Apart from a transfer of the mechanical setting movements between the door operating device and the door closing device of a motor vehicle door, it is also necessary to transfer electrical signals between the door operating device and the door closing device for electrically operated lock functions as well as for electrical parts integrated in the exterior door handle, such as for example a heater for the door lock cylinder, an infrared transmitter or light diodes mounted in the exterior door handle for displaying remote control locking, so that an electrical connection has to be produced between the exterior door handle and the door closing device or a control module connected to the door closing device. The electrical component parts in the exterior door handle are thereby to be contacted in the simplest way possible and where possible through a door module integrated in the door body. A connection of the door closing device to the exterior door handle or lock barrel and/or infrared receiver by means of a separate cable strand guided through the wet cell of the vehicle door is ruled out when using a door module since there is no longer any access to the wet cell of the motor vehicle door.

When fitting an inner door panel to separate the dry cell of the vehicle door from the wet cell a cable extending from the door closing device to the exterior door handle would block the mobility of the vehicle door pane and could be torn away through the movement of the window pane. Furthermore fitting a corresponding cable can only be achieved with considerable difficulty.

From DE 32 36 201 C2 it is known to connect electrical functions of a door handle, such as resistance heating for lock barrels, door lock lighting and micro switches through an electrically conductive plug connection to a connecting cable laid on the inside of the door and thus to the on-board electronics of a motor vehicle. By laying the cable protected on the inside of the door, mechanical damage to the cable insulation during fitting and dismantling is avoided and the security against theft is increased.

In order to make it easier to fit the device for transferring mechanical setting movements and/or electrical signals between the door operating device and the door closing device of a motor vehicle, the transfer device is to be produced so that only few hand actions are required from the outside panel of the vehicle door. When fitting the transfer device in this way it should be noted that for reasons of security against theft dismantling the transfer device may only take place when the vehicle door has previously been opened.

SUMMARY OF THE INVENTION

The object of the present invention is to provide a transfer device which transfers, selectively or combined, mechanical setting movements for the door functions of opening and closing as well as locking and unlocking and/or electrical signals for the mechanical door functions and additional electrical lock functions both by means of electrical signals and also combined by means of mechanical energy and electrical signals and allows a simple fitting particularly from the outside of the vehicle door. This is achieved /according to the invention through the features of claim 1.

The solution according to the invention allows a transfer of mechanical setting movements and/or electrical signals between a door closing device and a door operating device, which can be fitted with low assembly costs from the outside panel of a vehicle door and can be dismantled only when the vehicle door is opened and which is suitable both for transferring mechanical operating energy and also electrical signals and energy.

By integrating multiple door functions in the door operating device it is possible to provide greater processing reliability. Access into the dry cell of the motor vehicle door is only provided through a passage through the inner door panel, support plate or door module which can be easily sealed off. Even when using a door module a simple assembly is possible with a complete surface cover of the support plate. No additional cables, contacts or fastenings and no additional plugging of contacts are required for transferring electrical signals in the case of an electric operation of the door closing device.

The plug provided on the coupling element preferably has contacts connected to the door operating device through conductor paths for both door functions.

In a connection transferring solely electrical signals the coupling element consists of an electrical connection with plugs at both ends. The electrical signals and/or a translation displacement and/or rotational displacement govern electrical operating elements for locking and unlocking as well as for opening the vehicle door or operate same in the event of an additional transfer of electrical energy. To this end the coupling element can have electrical conductor paths for supplying energy for example for heating a lock barrel.

The plug provided on the coupling element can be associated with a paddle or a centring pin which simplifies the fitting of the transfer device without using separate leads, guarantees a reliable fitting and ensures that the transfer device takes up little space so that fewer processing steps are required during assembly.

A paddle provided on the plug can be used additionally to transfer rotary movements between the door operating device and the door closing device so that in addition to the centring function a transfer of mechanical operating energy is also provided.

The coupling element can be used in various ways, more particularly in a rotary adjustable design of the coupling element, starting from a locking position, a first rotary angular area of the coupling element can be used to unlock the vehicle door and an adjoining second rotary angular area can be used for opening the vehicle door.

In a preferred embodiment the door operating device is associated with a lock nut provided with contacts as a signal-generating element, with the contacts of the lock nut being operable by a key.

As an alternative to this, the door operating device can be associated as signal-generating element with a sensor-type receiving device formed as an infrared receiver wherein the control signals for operating the door functions can be received and forwarded. In addition or as an alternative the door operating device can have a light diode display to indicate remote control locking which is connected by contacts of the coupling device to a control electronics and where applicable to a voltage source.

The transfer device which is in one piece and is suitable selectively for transferring the mechanical door functions and/or electrical lock functions enables variable use in different types of door systems without having to change the basic design principle. With the transfer device it is possible to use control signals for triggering the door functions of opening and closing as well as locking and unlocking the vehicle door and also for transferring electrical energy for electrical devices, such as a lock heating, provided on the door operating device.

BRIEF DESCRIPTION OF THE DRAWINGS

The idea on which the invention is based will now be explained in further detail with reference to the embodiments shown in the drawings in which:

FIG. 9 shows a diagrammatic perspective view of a coupling element for the electrical signal transfer;

FIGS. 10 and 11 show different embodiments of the contact arrangement on coupling elements for transferring electrical signals;

DETAILED DESCRIPTION

Figure 1:
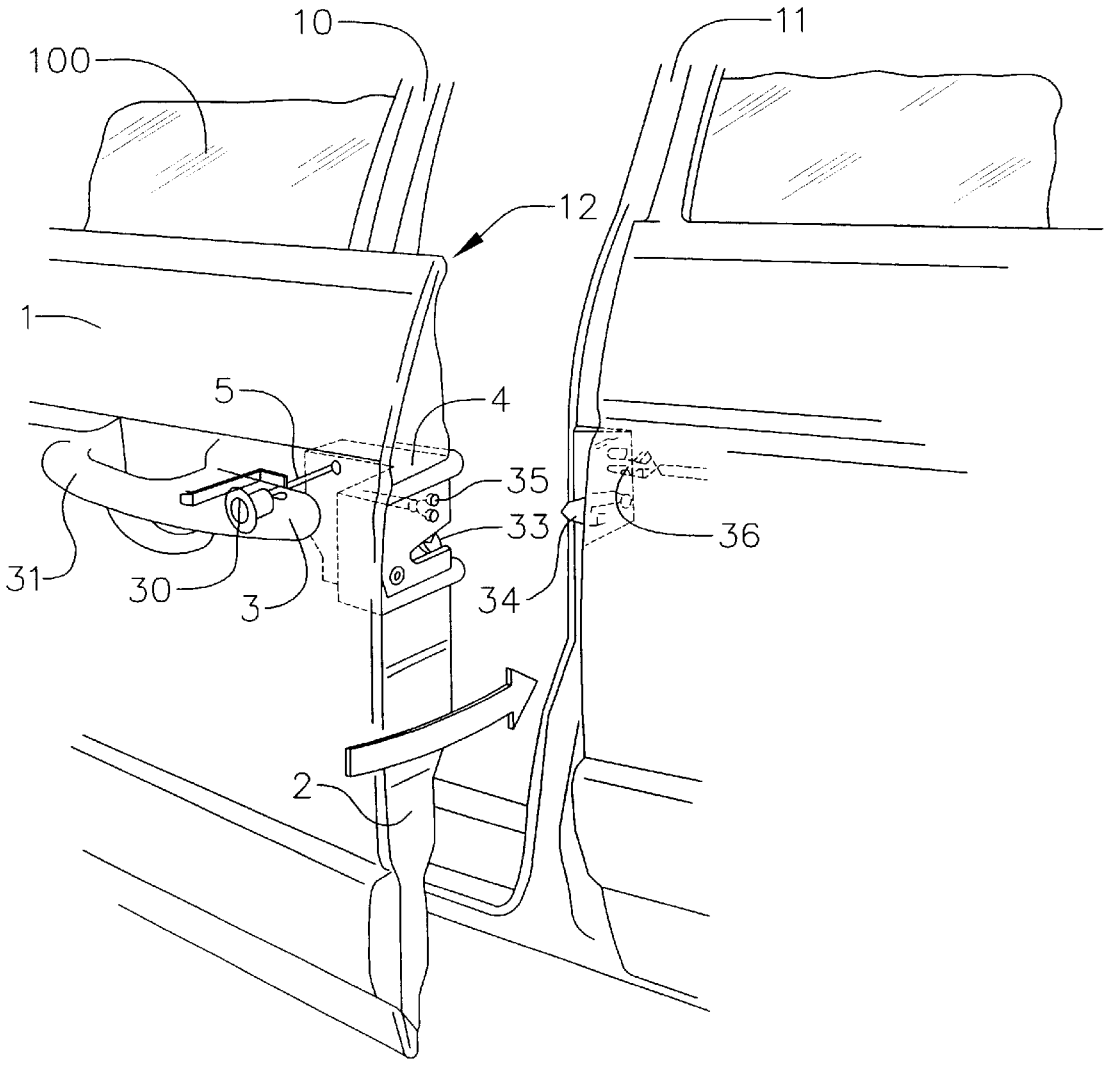
FIG. 1 shows a diagrammatic perspective explosive view of a part of a motor vehicle door.

FIG. 1 shows a diagrammatic perspective explosion view of a part of a motor vehicle door having a door body 12, which consists of an outer door panel 1 and an inner door panel 2, having an inner door trim (not shown in further detail), and having a window pane 100 guided in a window frame 10. The modular construction of the vehicle door enables extensive pre-fitting of individual parts and structural groups and a significantly improved pre-check on the existing function groups.

In the region of a door closing device 4 of the door body 12 an indentation is provided in the inner door panel 2 directed towards the hollow cavity of the door and housing the door lock. Between the door operating device 3 which consists of an exterior door handle 31 and a lock barrel 30, and the door closing device 4 there is a coupling element 5 which is guided through the inner door panel which 2 separates the wet cell from the dry cell of the vehicle door.

In order to fully exploit the advantages of the separation of the wet and dry cells through the inner door panel 2 or a support plate for holding the function elements of the vehicle door, as many of the components as possible and more particularly the electrical components are mounted on the dry cell side. The dry cell designs of the functional structural groups are significantly cheaper than the more complicated wet cell designs.

The slit 33 in the door lock 4 engages into a closing element 34 mounted on the B-pillar 11 (or in the case of a rear door the C-pillar) of the vehicle. Furthermore the door lock 4 is connected through a coupling rod (not shown in further detail) to the handle of an unlocking device on the inside, as well as where applicable to a cable for supplying the vehicle door with electrical energy and signals and to contact elements 35, 36 which are aligned with each other and are attached to a power supply source and/or an electronic control unit.

The coupling element 5 can be inserted from the outside of the door and can be connected to elements of the door closing device so that dismantling is only possible when the vehicle door is opened.

The various possibilities for transferring door functions by means of a one-piece coupling element 5*a* to 5*d* are shown diagrammatically in FIG. 2*a*-2*d*.

Figure 2:
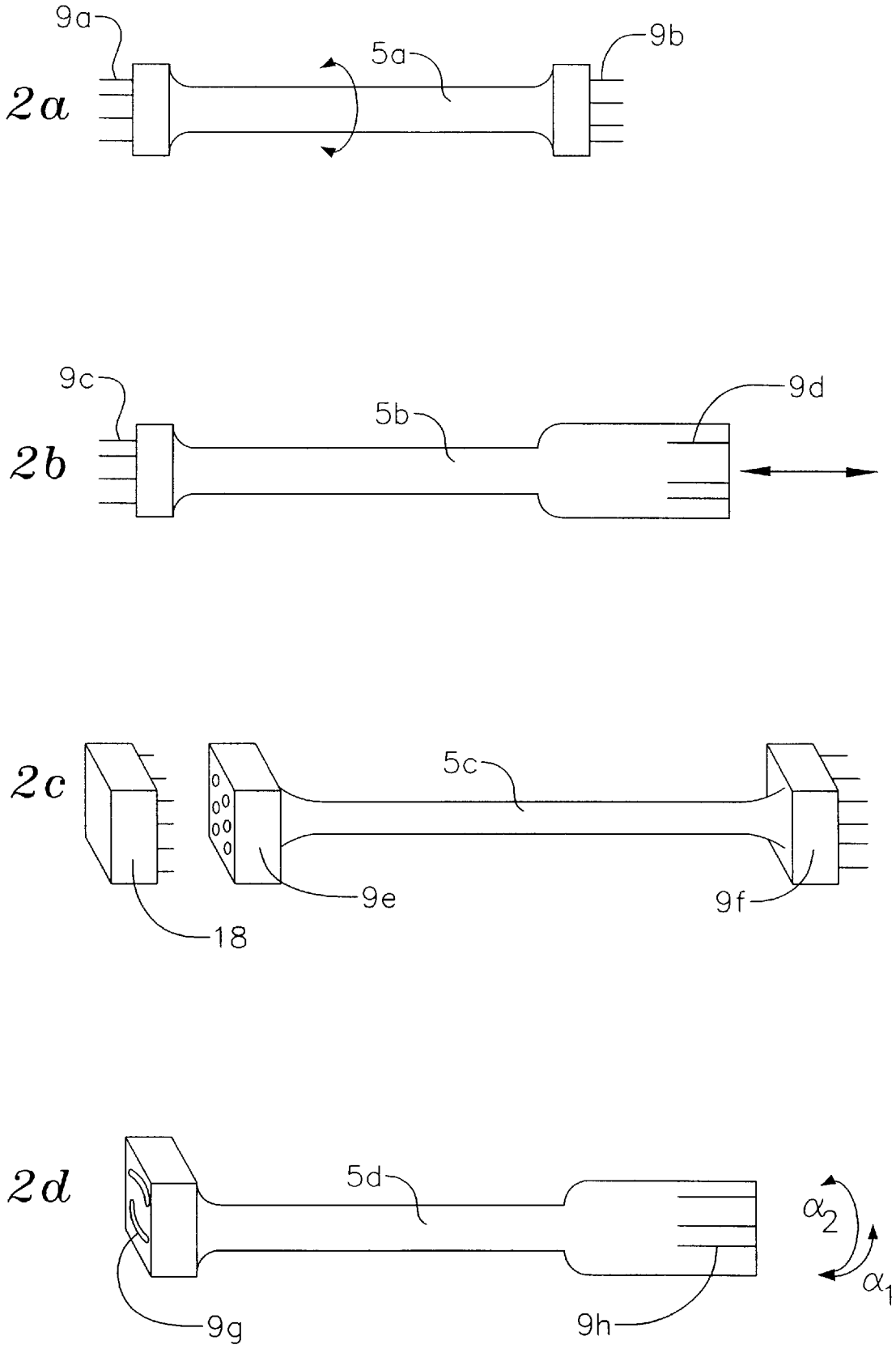
FIG. 2 shows a diagrammatic view of different mechanical and electrical transfer functions of a coupling element between a door operating device and a door closing device.

FIG. 2*a* shows a one-piece coupling element 5*a* for the combined transfer of mechanical energy and electrical signals. The coupling element 5*a* is formed rotatable and has at its ends electrical contacts 9*a* and 9*b* which are connected together through conductor paths. The electrical contacts 9*a* and 9*b* mounted at the ends of the coupling element 5*a* are connected on one side to a signal transmitter mounted on the door operating device and on the other side to an electrical operating element mounted in the door closing device. The rotary movement of the coupling element 5*a* is preferably used to transfer mechanical energy for locking and unlocking the vehicle door and the electrical connection is preferably used for switching an electrical operating element for opening the vehicle door.

Furthermore the possibility exists of using the electrical connection also for transferring electrical energy, for example for the power supply to a lock heater and/or for receiving or transmitting control signals for an infrared receiver or transmitter installed in the exterior door handle as well as for a light diode display for displaying a remote control locking.

FIG. 2*b* shows a one-piece coupling element 5*b* which likewise transfers combined mechanical energy and electrical signals from the door operating device to the door closing device. In this embodiment the coupling element 5*b* is designed for translation displacement and axial adjustment and supports at its end electrical contacts 9*c* and 9*d* which are connected together through conductor paths. The electrical contacts 9*c* and 9*d* are connected on one side to a signal transmitter mounted in the door operating device and on the other side to an electrical operating element connected to the door closing device. The electrical connection advantageously serves in this embodiment for switching the electrical operating element for the purpose of locking and unlocking the vehicle door, whilst the transfer of mechanical energy through a displacement movement is used to open the vehicle door.

FIG. 2*c* shows a one-piece coupling element 5*c* which is formed as an electrical connection with plugs 9*e* and 9*f* at both ends. This coupling element 5*c* can be used both solely for transferring electrical signals and also for the combined transfer of mechanical energy and electrical signals. The electrical signals and/or the mechanical operating energy serve to control and/or operate electrical operating elements in the door operating device and the door closing device for the purpose of locking and unlocking and for opening the vehicle door.

One variation proposes connecting the one plug 9*e* to a plate 18 on the door operating device through which control signals for an infrared receiver as signal-generating element for example for triggering the door functions are received and forwarded from an infrared transmitter and/or light diodes in the exterior door handle are controlled for displaying remote control locking. With a combination of both signals the switching state is displayed of the infrared receiver for controlling the central locking, i.e. forwarding the received signal.

FIG. 2*d* shows a one-piece coupling element 5*d* for transferring rotary movements wherein, starting from a locking position, a first rotary angular range $\alpha_1$ serves for unlocking the vehicle door and an adjoining second rotary angular range $\alpha_2$ serves for opening the door.

The coupling element 5*d* has at its one end mounted in the door operating device electrical loop contacts 9*g* through which for example electrical energy is transferred to a lock heater. At the other end mounted in the region of the door closing device, contact plugs 9*h* are provided which can be connected electrically to a corresponding contact socket mounted in the coupling which can be connected to the paddle.

The variations of a coupling element between a door closing device and door operating device as described above provide various connecting possibilities which can still be varied in many ways.

Figure 3:
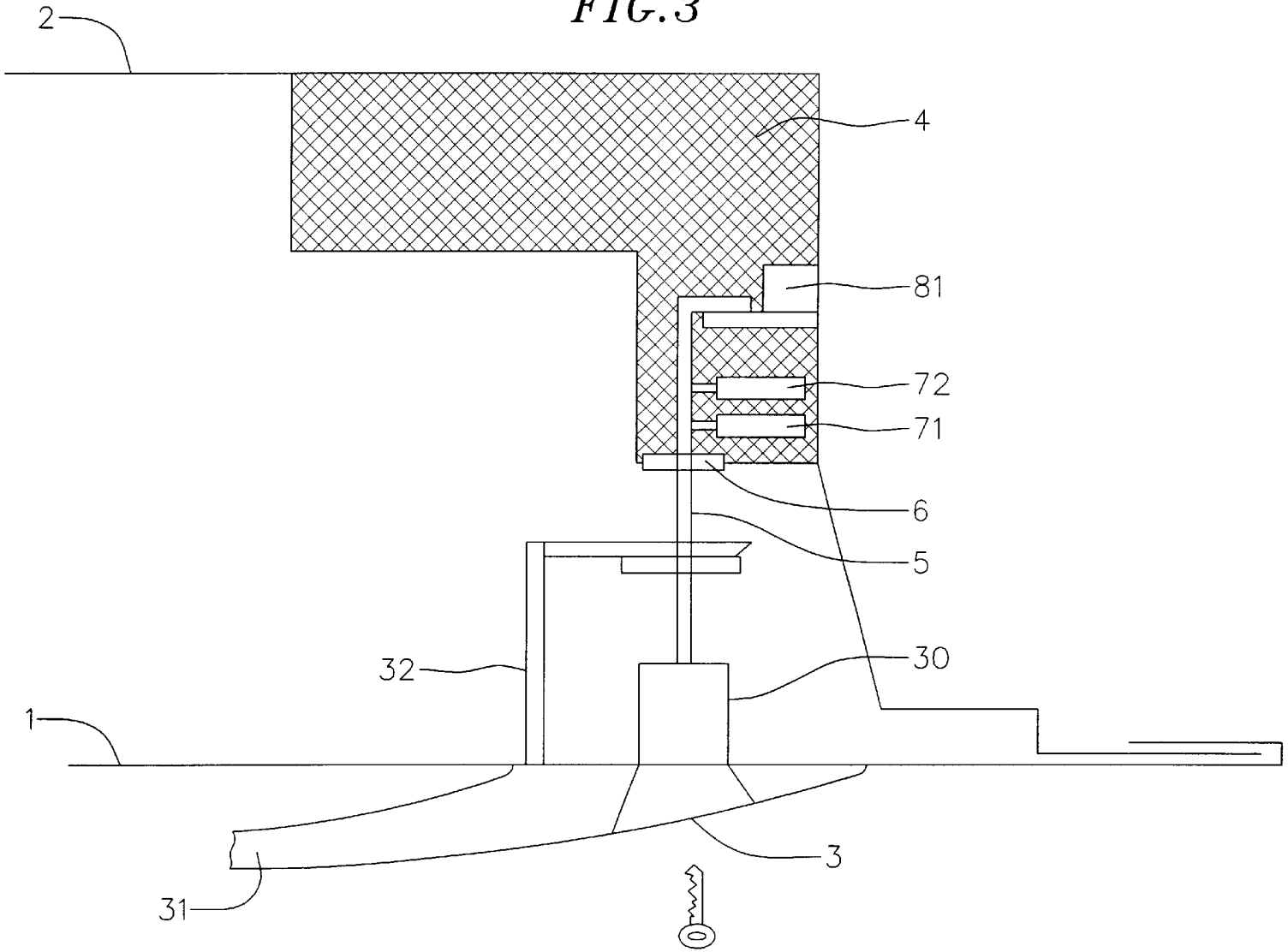
FIG. 3 shows a sectional view through a motor vehicle in the region of the door closing device and the door operating device.

FIG. 3 shows a section through a motor vehicle door having an exterior door panel 1 and an inner door panel 2 separating the wet cell of the vehicle door from the dry cell. A door operating device 3 containing a lock barrel 30 and a exterior door handle 31 is fixed on the outer door panel 1. In the dry cell area of the motor vehicle door a door closing device (door lock) 4 is connected to the inner door panel 2 wherein the door closing device 4 comprises in the normal way a housing, closing elements, locking elements and operating elements for the locking elements, and the closing elements consist for example of a rotary or forked catch and a locking pawl and the locking elements can contain where applicable a servo motor for a central locking unit.

The connection between the operating device 3 and the door closing device 4 is by means of a coupling element 5 which is formed in this embodiment as a transmission lever. The transmission lever 5 transfers rotary movements of the lock barrel 30 and translation displacements of the exterior door handle 31, which are transferred to the transmission lever 5 by means of a claw 32 fixed on the exterior door handle 31.

The passage of the transmission lever 5 through the inner door panel 2 is sealed by a sealing sleeve 6 so that the single passage in the inner door panel for transferring the door functions from the operating device 3 to the door closing device 4 is completely sealed and thus there is no interruption in the separation of the wet cell from the dry cell of the vehicle door.

On the dry cell side, micro switches 71, 72 as well as a locking pawl operating lever 81 are associated with the transmission lever 5 in the area of the door closing device 4.

Figure 4:
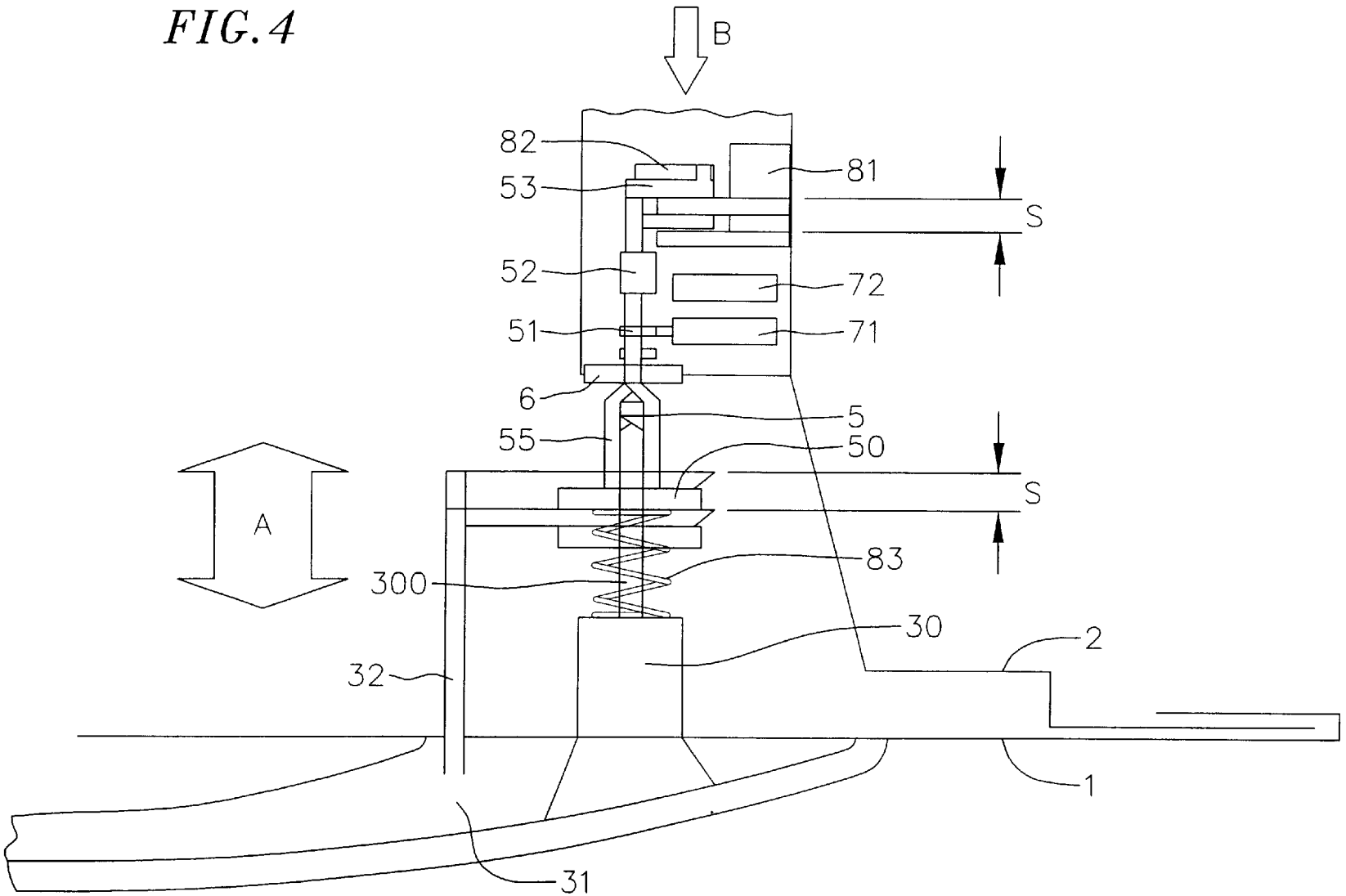
FIG. 4 shows an enlarged view of the mechanical force transfer device of the door operating device and the door closing device.

Details of the connecting mechanism between the operating device 3 and the door closing device 4 can be drawn from FIG. 4.

The claw 32 connected to the exterior door handle 31 adjoins a flange 50 of the transmission lever 5 which has a forked opening 55 for keyed connection with a lock barrel transmission lever 300 connected to the lock barrel 30. Operating the exterior door handle 31 in the direction of the double arrow A leads to an operating path S for the translation displacement of the transmission lever 5. This operating path S is also transferred to the locking pawl operating lever 81 by means of an end plate 53 of the transmission lever 5.

As a result of the keyed connection of the lock barrel transmission lever 300 with the forked opening 55 of the transmission lever 5 a rotary movement of the lock barrel 30 is transferred to switching cams 51, 52 of the transmission lever 5 for the micro switches 71, 72 as well as, through a shaft of the end plate 53, to an operating lever 82 for the locking mechanism.

Figure 5:
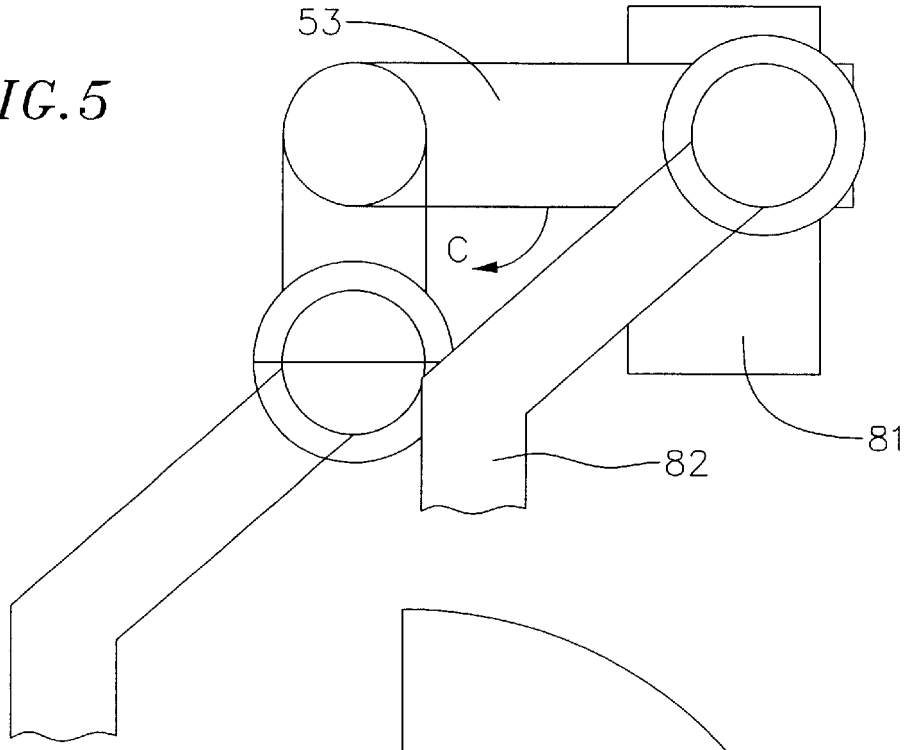
FIGS. 5 and 6 are partial views of two versions of the coupling element in different positions.
Figure 6:
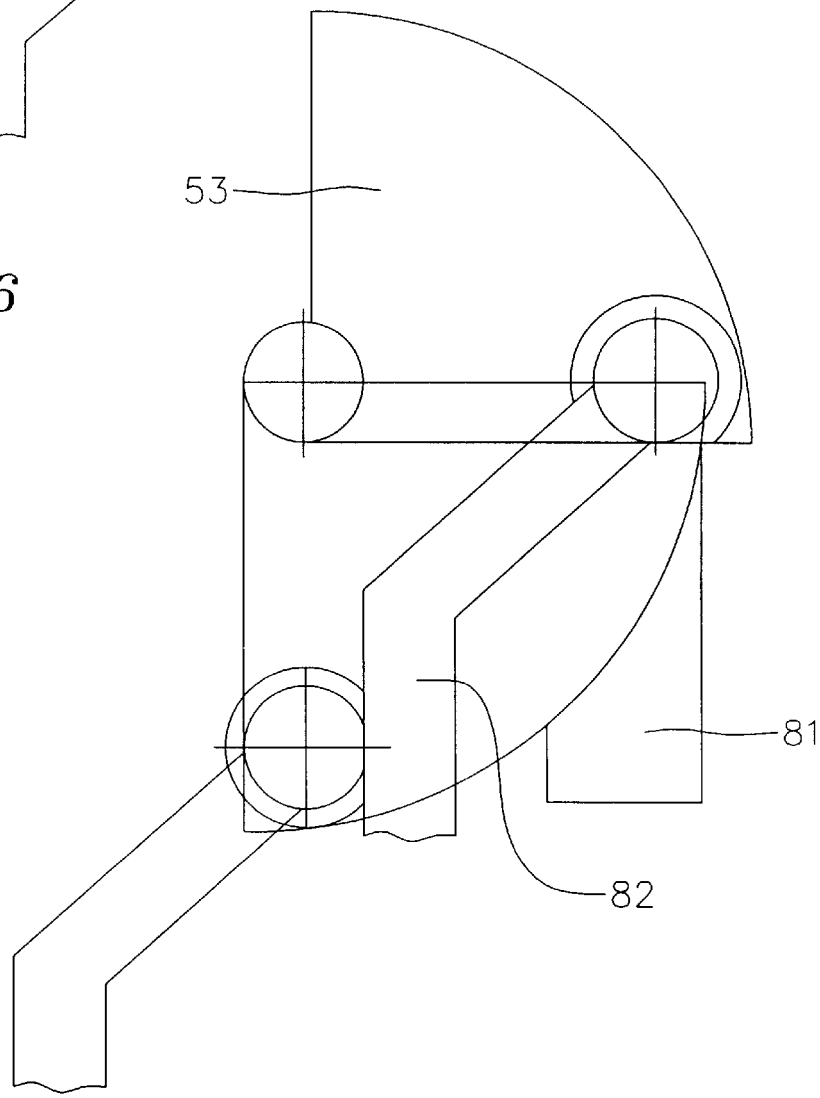

FIGS. 5 and 6 show two versions of transferring the rotary movement of the end lever 53 of the transmission lever 5 in a view B according to FIG. 4.

A first version shown in FIG. 5 of the connection of the transmission lever 5 to the operating lever 82 for the locking mechanism and the locking pawl operating lever 81 shows in thick lines the position in which the transmission lever 5 is in engagement with the operation for the locking pawl, whilst on turning the transmission lever 5 about 90° in the direction of arrow C the transmission lever 5 comes out of engagement with the locking pawl operating lever 81 as shown by the thin lines.

In a second version FIG. 6 shows in thick lines the connection of the end plate 53 of the transmission lever 5 with the operating lever 82 for the locking mechanism as well as in thin lines the position where the transmission lever 5 is not in engagement with the operating lever for the locking mechanism. The locking pawl operating lever 81 is not contacted by a rotary movement of the end plate 53 of the transmission lever 5, it is displaced by translation displacement movements of the transmission lever 5 according to FIG. 4 about the operating path S for the locking pawl operation.

Figure 7:
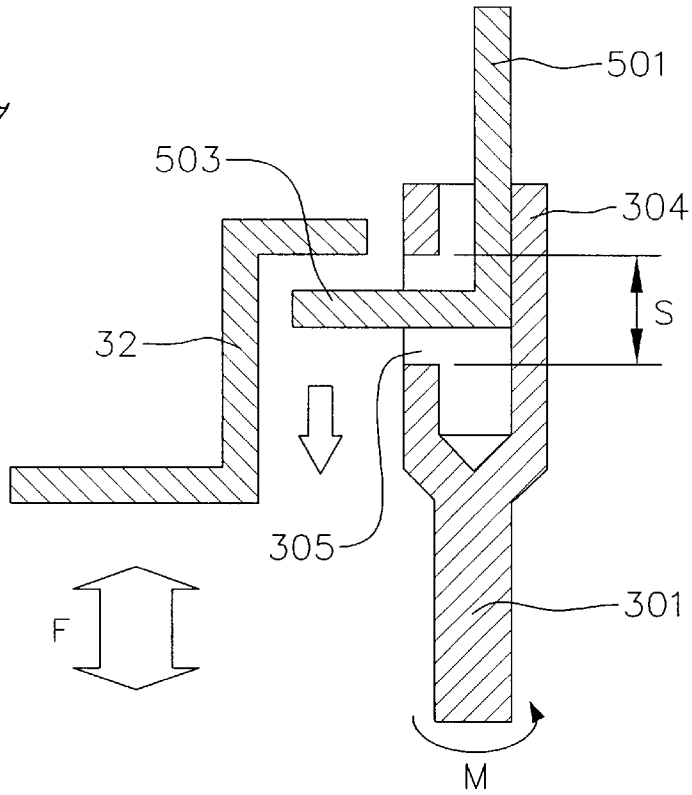
FIGS. 7 and 8 show further different embodiments of a mechanical coupling element.
Figure 8:
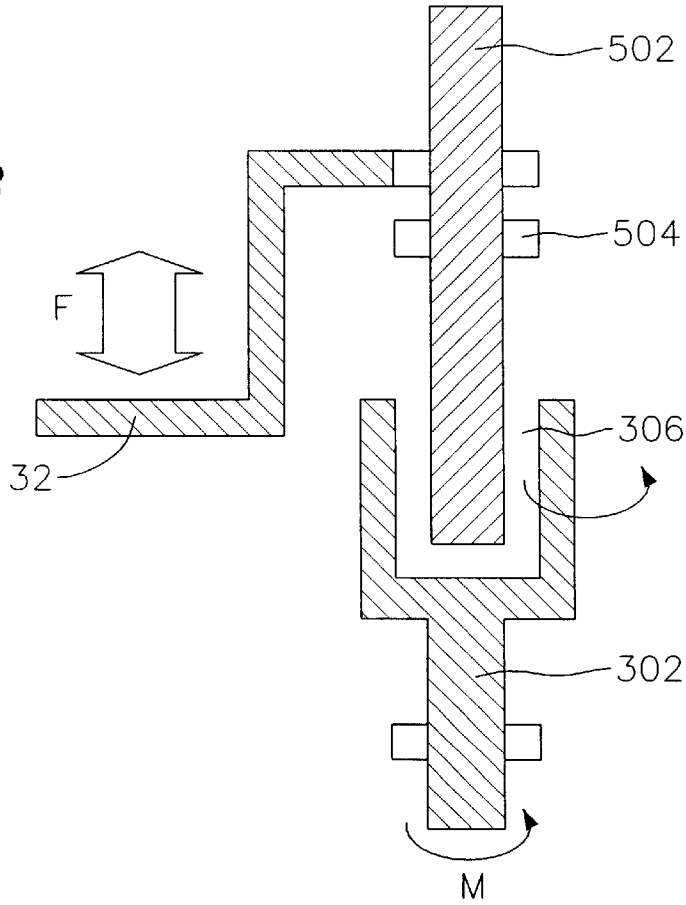

FIGS. 7 and 8 show two further embodiments of the connection between the transmission lever 5 and the outside door handle claw 32 and the lock barrel transmission lever 300 wherein the transmission lever 5 is fixedly connected to the door lock. Unlocking the door lock is preferably carried out by a rotary movement transferred to the transmission lever by means of the lock barrel transmission lever, and the opening of the door lock is carried out by an exterior door handle claw connected to the exterior door handle.

FIG. 7 shows a transmission lever as a angle 501 which is angled at one end side and is guided in a socket 304 of the lock barrel transmission lever 301 and projects with the angled end out of a slit 305 of the socket 304. The angled end of the claw 32 which is connected to the exterior door handle engages on the angled end of the transmission angle 501 and in the event of a displacement in the direction of the double arrow F leads to a translation displacement of the transmission angle 501 about the displacement path S which is provided by the slit 305 in the socket 304 of the lock barrel transmission lever 301.

A rotary movement of the lock barrel transmission lever 301 in the direction of arrow M leads through the slit socket 304 of the lock barrel transmission lever 301 to an entrainment of the transmission angle 501 and thus likewise to a rotary movement of the transmission angle 501 which can preferably be clipped into the socket 304 in order to simplify assembly.

FIG. 8 shows an embodiment of the transfer mechanism for moving in translation or rotation a transmission lever 502 whose one end is mounted in a forked opening 306 of a lock barrel transmission lever 302. The claw 32 connected to the exterior door handle has a fork engaging round the transmission lever 502 which is connected to the door lock, and transferring a translation movement in the direction of the double arrow F through a collar 504 to the transmission lever 52. A force and/or positive locking connection of the transmission lever 502 with the socket 306 of the lock barrel transmission lever 302 serves to transfer rotary movements of the lock barrel which are transferred to the door lock by means of the transmission lever 502.

FIGS. 9 to 11 show different embodiments of a transfer device for electrically coupling the door operating device to the door closing device.

FIG. 9 shows a transmission lever 5 having a sealing sleeve 6 for sealing the passage of the transmission lever 5 through the inner door panel. At the end of the transmission lever 5 is a plug contact 9 which serves to contact the transfer device with the door operating device or door closing device. The plug contact 9 has several contacts 90 on the circumference of the plug contact 9 as well as several sockets 91 which serve both to transfer signals and to transfer electrical energy for example for the lock barrel heater, wherein a variable contact surface allows a differentiation between signal transfer and energy transfer. The plug device is designed for right and left fitting. The opposite end of the transmission lever 5 is provided with a corresponding mirror-symmetrical plug contact 9.

FIGS. 10 and 11 show variations of the design of the plug device with contact faces 92 and 93 for signal and/or energy transfer.

Figure 12:
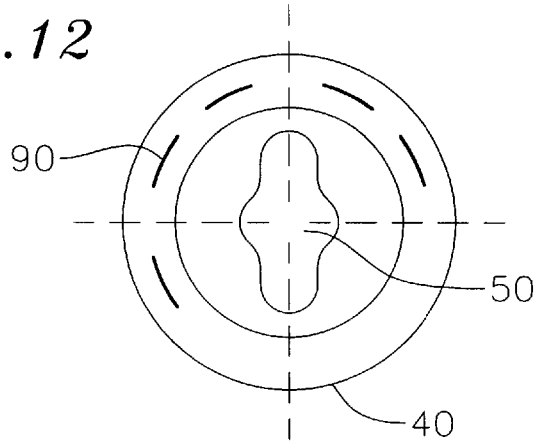
FIG. 12 shows an arrangement of the electrical contacts for the lock barrel and infrared receiver on a door lock.

FIG. 12 shows a diagrammatic plan view of a lock nut 40 of a door closing device wherein several contacts 90 for the lock barrel and an infrared receiver are arranged in a ring. A centring lever engagement 50 mounted centrally in the lock nut 40 serves for centring the coupling element or transmission lever 5.

Figure 13:
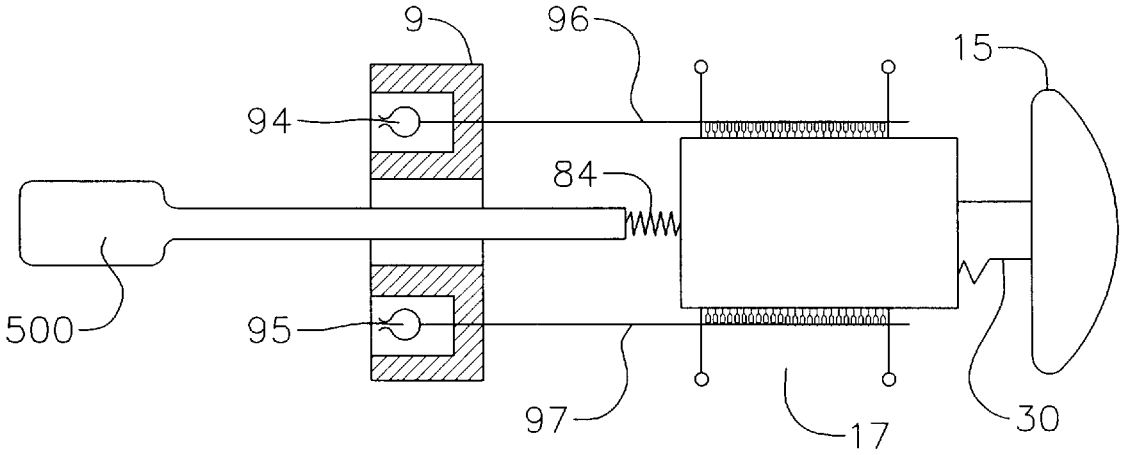
FIG. 13 shows a longitudinal sectional view through a door operating device with a lock barrel and a coupling element transferring electrical signals.
Figure 14:
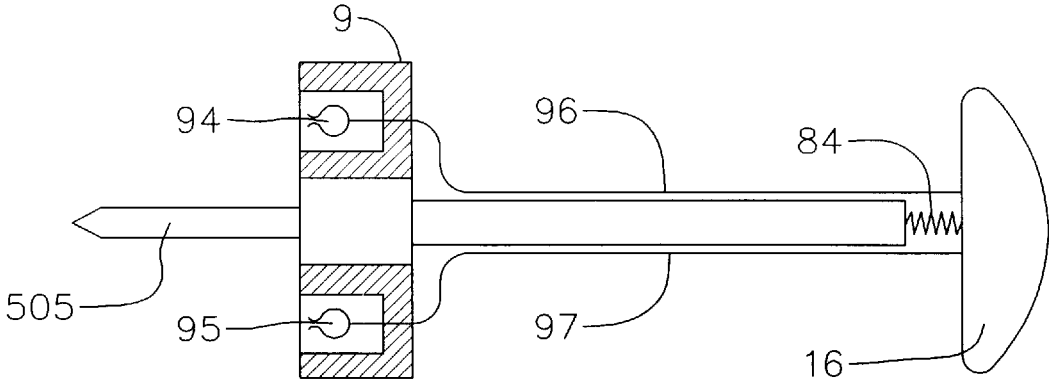
FIG. 14 shows a longitudinal sectional view through a door operating device with an infrared receiver and a coupling element transferring electrical signals.
Figure 15:
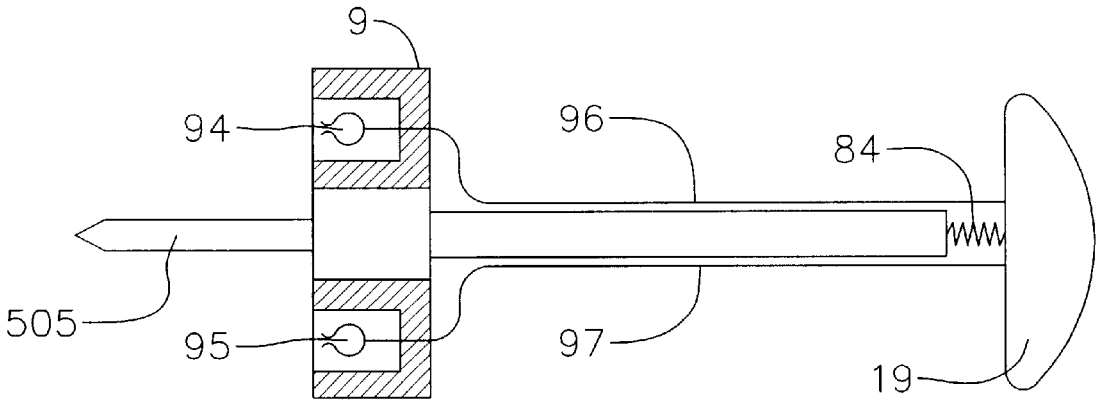
FIG. 15 shows a longitudinal sectional view through a door operating device with a light diode display and a coupling element transferring electrical signals.

FIGS. 13 and 14 show two embodiments for connecting a coupling element to a lock barrel or infrared receiver.

FIG. 13 shows a lock barrel 30 which can be operated by a key 15 and which is connected to a plug contact 9 by cables 96, 97. The cables are connected in the plug contact 9 to contacts 94, 95 which are designed so that compensating length is possible with the plugs inserted in the contacts 94, 95 so that tolerances can be compensated in the axial direction.

A paddle 500 is connected by a compensating spring 84 to the lock barrel 30 and serves to guide and centre the coupling element in the door lock as well as in the case of necessity also to transfer mechanical energy for triggering the door functions opening/closing, locking/unlocking or safety switch.

A lock heater 17 is fed with energy from the on-board mains supply through additional electrical contacts wherein the connection is likewise provided through electrical contacts of the coupling element.

FIG. 14 shows an arrangement where instead of the lock barrel 30 and the paddle 500 an infrared receiver 16 is provided in conjunction with a centring pin 505 connected to the plug 9 and engaging in place of the paddle 500 in the centring engagement 50 of the lock nut according to FIG. 12 to solely execute centring functions.

The coupling elements shown in FIGS. 9 to 14 transferring electrical signals as well as mechanical and electrical energy enable a simple assembly preferably from the outside of the door without the use of separate leads. Through the automatic centring of the contacts through the paddle 500 or centring pin 505 assembly is safe and reliable. Furthermore the arrangement takes up little space so that fewer processing steps are necessary during assembly.

The solution according to the invention can be used with particular advantage in conjunction with a door module but can also be used with advantage in the case of conventional doors without a door module. When using a door module the contacting of the electrical parts in the exterior door handle is only possible through the solution according to the invention since a cable cannot be used for contacting since the door pane is in the way.

Further variations exist where instead of a lock barrel only an array of lamps or light diode display 19 is provided in the exterior door handle, for example in the case of central locking. The electrical contacts serve to transfer signals and electrical energy for example to a transponder when a transponder electronics unit is integrated in the door electronics. Furthermore an energy transfer to an external display for central locking can take place.

LIST OF REFERENCE NUMERALS

| | |
|---|---|
| 1 | Exterior door panel |
| 2 | Interior door panel |
| 3 | Door operating device |
| 30 | Lock barrel |
| 300 | Lock barrel transmission lever |
| 301 | Lock barrel transmission lever |
| 302 | Lock barrel transmission lever |
| 304 | Socket |
| 305 | Slit |
| 306 | Forked opening |
| 31 | Exterior door handle |
| 32 | Exterior door handle claw |
| 33 | Slit of door lock |
| 34 | Closing element |

-continued

| LIST OF REFERENCE NUMERALS | |
|---|---|
| 35 | Contact elements |
| 36 | Contact elements |
| 4 | Door closing device |
| 40 | Lock nut |
| 5–5d | Coupling element |
| 50 | Flange of transmission lever |
| 500 | Paddle |
| 501 | Transmission angle |
| 502 | Transmission lever |
| 504 | Collar |
| 505 | Centring pin |
| 51 | Switch cam |
| 52 | Switch cam |
| 53 | End plate of transmission lever |
| 55 | Forked opening |
| 6 | Sealing sleeve |
| 71 | Microswitch |
| 72 | Microswitch |
| 81 | Locking pawl operating lever |
| 82 | Operating lever for locking mechanism |
| 84 | Compensating spring |
| 9 | Plug |
| 9a–h | Contacts |
| 90 | Contacts |
| 91 | Sockets |
| 92 | Contact surface |
| 93 | Contact surface |
| 94 | Contact |
| 95 | Contact |
| 96 | Cable |
| 97 | Cable |
| 10 | Window frame |
| 11 | B pillar |
| 12 | Door body |
| 15 | Key |
| 16 | Infrared receiver |
| 17 | Lock heater |
| 18 | Plate |
| 100 | Window pane |

What is claimed is:

1. An arrangement for transferring electrical signals or combined electrical signals and mechanical setting movements for a motor vehicle door having an exterior door panel, an interior door panel and a support plate, the arrangement comprising:

a door operating device mounted on an exterior door panel of the motor vehicle door;

a door closing device mounted on one of an interior door panel and a support plate; and a transfer device including a displaceable coupling element being formed as one piece and through which electrical signals and mechanical energy are transmitted between the door operating device and the door closing device for two door functions;

wherein the two door functions include opening/closing and locking/unlocking and the coupling element includes at least one plug connectable with an electrical contacting site on one of the door closing device and on the support plate, such that electrical signals utilized for the two door functions are transferable through the electrical contacting site.

2. The arrangement according to claim 1 wherein the electrical signals include electrical energy for feeding component parts on the door operating device and transferred through the electrical contacting site.

3. The arrangement according to claim 1 or 2 wherein the at least one plug has contacts connected to the door operating device through conductor paths for the two door functions and voltage connections for component parts of the door operating device.

4. The arrangement according to claim 1 further comprising a paddle associated with the at least one plug.

5. The arrangement according to claim 4 wherein the paddle transfers a rotational movement.

6. The arrangement according to claim 1 wherein the coupling element is rotationally displaceable and starting from a locking position a first rotary angular area unlocks the motor vehicle door and an adjoining second rotary angular area opens the motor vehicle door.

7. The arrangement according to claim 1 further comprising a lock nut provided with contacts and is associated with the door operating device as a signal-generating element wherein the contacts are operable by a key.

8. The arrangement according to claim 1 further comprising a sensor-type receiving device formed as an infrared receiver and is associated with the door operating device as a signal-generating element through which control signals are received and forwarded for triggering at least one of the two door functions.

9. The arrangement according to claim 1 wherein the door operating device has a light diode display for displaying a remote control locking which is connected through contacts of the coupling element to control electronics and to a voltage source.

10. The arrangement according to claim 1 wherein the coupling element includes electrical conductor paths for supplying energy to a heater for a lock barrel.

11. The arrangement according to claim 1 wherein the electrical signals include electrical energy for feeding component parts in the door operating device and transferred through the electrical contacting site.

12. The arrangement according to claim 2 wherein the at least one plug has contacts connected to the door operating device through conductor paths for one of voltage connections for component parts of the door operating device and the two door functions.

13. The arrangement according to claim 1 further comprising a centring pin associated with the at least one plug.

14. The arrangement according to claim 1 wherein the door operating device has a light diode display for displaying a remote control locking which is connected through contacts of the coupling element to one of a voltage source and control electronics.

15. The arrangement of claim 1 wherein the coupling element is displaceable rotationally.

16. The arrangement of claim 1 wherein the coupling element is displaceable translationally.

17. The arrangement of claim 1 wherein the coupling element is displaceable rotationally and translationally.

18. An arrangement for transferring electrical signals or combined electrical signals and mechanical setting movements for a motor vehicle door having an exterior door panel, an interior door panel and a support plate, the arrangement comprising:

a door operating device mounted on an exterior door panel of the motor vehicle door;

a door closing device mounted on one of an interior door panel and a support plate; and a transfer device including a displaceable coupling element being formed as one piece and through which electrical signals and mechanical energy are transmitted between the door operating device and the door closing device for two door functions;

wherein the two door functions include opening/closing and locking/unlocking and the coupling element includes at least one plug connectable with an electrical contacting site on one of the door closing device and on the support plate, such that electrical signals utilized for one of the two door functions are transferable through the electrical contacting site and mechanical setting movements, through the displaceable coupling element, are transmitted for another one of the two door functions.

19. The arrangement according to claim 18 wherein the electrical signals include electrical energy for feeding component parts on the door operating device and transferred through the electrical contacting site.

20. The arrangement according to claim 18 wherein the electrical signals include electrical energy for feeding component parts in the door operating device and transferred through the electrical contacting site.

21. The arrangement according to claim 19 wherein the at least one plug has contacts connected to the door operating device through conductor paths for the two door functions and voltage connections for component parts of the door operating device.

22. The arrangement according to claim 19 wherein the at least one plug has contacts connected to the door operating device through conductor paths for one of voltage connections for component parts of the door operating device and the two door functions.

23. The arrangement according to claim 18 further comprising a paddle associated with the at least one plug.

24. The arrangement according to claim 23 wherein the paddle transfers a rotational movement.

25. The arrangement according to claim 18 further comprising a centring pin associated with the at least one plug.

26. The arrangement according to claim 18 wherein the coupling element is rotationally displaceable and starting from a locking position a first rotary angular area unlocks the motor vehicle door and an adjoining second rotary angular area opens the motor vehicle door.

27. The arrangement according to claim 18 further comprising a lock nut provided with contacts and is associated with the door operating device as a signal-generating element wherein the contacts are operable by a key.

28. The arrangement according to claim 18 further comprising a sensor-type receiving device formed as an infrared receiver and is associated with the door operating device as a signal-generating element through which control signals are received and forwarded for triggering at least one of the two door functions.

29. The arrangement according to claim 18 wherein the door operating device has a light diode display for displaying a remote control locking which is connected through contacts of the coupling element to control electronics and to a voltage source.

30. The arrangement according to claim 18 wherein the door operating device has a light diode display for displaying a remote control locking which is connected through contacts of the coupling element to one of a voltage source and control electronics.

31. The arrangement according to claim 18 wherein the coupling element includes electrical conductor paths for supplying energy to a heater for a lock barrel.

32. The arrangement of claim 18 wherein the coupling element is displaceable rotationally.

33. The arrangement of claim 18 wherein the coupling element is displaceable translationally.

34. The arrangement of claim 18 wherein the coupling element is displaceable rotationally and translationally.

* * * * *